US006155672A

United States Patent [19]

Suetsugu et al.

[11] Patent Number: 6,155,672

[45] Date of Patent: Dec. 5, 2000

[54] APPARATUS AND METHOD FOR INK-JET PRINTING USING EXTENDING INK-EJECTING BARS AND METHOD OF MANUFACTURING OF THE APPARATUS

[75] Inventors: Junichi Suetsugu; Kazuo Shima; Tadashi Mizoguchi; Hitoshi Minemoto; Hitoshi Takemoto; Yoshihiro Hagiwara; Toru Yakushiji, all of Niigata, Japan

[73] Assignee: NEC Corporation, Tokyo, Japan

[21] Appl. No.: 08/988,183

[22] Filed: Dec. 10, 1997

[30] Foreign Application Priority Data

Dec. 17, 1996 [JP] Japan ..... 8-337320

[51] Int. Cl.[7] ..... B41J 2/06

[52] U.S. Cl. ..... 347/55

[58] Field of Search ..... 347/151, 120, 347/141, 17, 55, 154, 103, 123, 111, 159, 127, 128, 54, 68, 70, 71, 72; 399/271, 290, 292, 293, 294, 295

[56] References Cited

U.S. PATENT DOCUMENTS 4,504,844 3/1985 Ebi et al. .
5,576,747 11/1996 Sohn .
5,619,234 4/1997 Nagato et al. .

FOREIGN PATENT DOCUMENTS 8-309993 11/1996 Japan .

*Primary Examiner*—John Barlow
*Assistant Examiner*—Raquel Yvette Gordon
*Attorney, Agent, or Firm*—Sughrue, Mion, Zinn Macpeak & Seas, PLLC

[57] ABSTRACT

An ink-jet printing apparatus, having (a) a plurality of ink-ejecting bars each having a pointed end, the pointed end being capable of moving toward a recording medium; (b) an ink reservoir for supplying to each of the ink-ejecting bars with ink including toner; (c) a counter electrode for drawing the toner in ink from a location faced to the pointed end of said ink-ejecting bar, said counter electrode and the ink ejecting bar interposing the recording member; and (d) recording electrodes for flying the toner in ink from the pointed end of each of the ink-ejecting bars.

30 Claims, 7 Drawing Sheets

APPARATUS AND METHOD FOR INK-JET PRINTING USING EXTENDING INK-EJECTING BARS AND METHOD OF MANUFACTURING OF THE APPARATUS

BACKGROUND OF THE INVENTION

The present invention relates to an electrostatic type of ink-jet recording head and a printing method.

Since noise at a time of printing is extremely small to the extent that is could be ignored, recently, non-impact recording methods attract a lot great deal of interest. An ink-jet recording method is such a method.

The ink-jet recording method is capable of printing directly on a recording medium with high speed and with a simple mechanism. Also, because of the ability to record on an ordinary paper, this method is popular, and various systems have been proposed therefor.

In general, in ink-jet recording method, the process of supplying ink into grooves of a substrate, concentrating ink to an end side of the substrate, and transporting (metering) this ink from the end of the substrate to the recording medium, have been employed.

During the step of concentrating ink to the ends of the substrate, in the conventional processes ink would overflow from the interiors to the end sides of the substrate, thereby causing inaccurate metering of ink from the fixed location.

SUMMARY OF THE INVENTION

Therefore, an object of the present invention is to prevent an overflow of ink at a time of printing.

Also, another object of this invention is to provide an ink-jet printing apparatus and a printing method in which an injection location of ink is stabilized.

Yet, another object of the invention is to enabling controlling the dot size of the ink.

Accordingly, the present invention attempts to achieve these objects by including a plurality of ink-ejecting bars each having a pointed end (said pointed end being capable of moving toward a recording medium), an ink reservoir for supplying to each of said ink-ejecting bars with ink including toner, a counter electrode for drawing said toner in ink from the pointed end of the ink-ejecting bar, said counter electrode and said ink ejecting bar interposing the recording medium, and recording electrodes for transporting said toner in ink from said pointed end of each of said ink-ejecting bars.

In the present invention at the time of printing, the pointed end of the ink-ejecting bar shifts toward the recording medium. Also, at the same time, a voltage with the same polarity as the toner is supplied to a recording electrode of this ink-ejecting bar. Thereby, a concentration of an electromagnetic field is produced in the pointed end of the extending ink-ejecting bar. Because of the electromagnetic field, the toner in ink becomes attracted to the counter electrode. Then toner (is transported or metered) to the recording medium in front thereof and the printing is implemented.

Because ink may concentrate on the pointed end of the ink-ejecting bar, the injection location of ink will be limited to a range of extension of this pointed face, thereby it is possible to implement a stable printing without a displacement of a location.

Further, in the present invention, printing is implemented according to the following steps. First, ink and toner are supplied including toner a plurality of ink-ejecting bars facing a recording paper. Next, transporting the supplied ink to the pointed end side of each the ink-ejecting bars by using the counter electrode which draws the toner through the recording medium. Further, shifting a pointed end of the ink-ejecting bars toward the recording medium. Then, flying toner in ink of the pointed end of the ink-ejecting bar to a direction of a recording paper.

That is, according to the above mentioned method, it is possible to concentrate ink to the pointed face of the pointed end of ink-ejecting bar, and then to fly toner from within this narrow range toward the recording paper.

Also, another object of the present invention is to attempt a simplification of a manufacturing process of an ink-jet printing apparatus.

In the present invention, an ink-jet printing apparatus is manufactured according to the following process. At first, depositing conductive materials on both sides of a plate of a piezoelectric material. Next, peeling off each of conductive materials deposited on both sides of the piezoelectric material in stripes, in order to form electrodes. Further, cutting and dividing a connected body of an ink-ejecting bar, from the piezoelectric material on which the electrodes are formed. Then, cutting deeply from one end to a mid-way of a connected body, for each gap between electrodes of the connected body of the ink-ejecting bar which has been cut and divided. Further, coating both sides of the connected body on which deep cuts are made, with insulating materials. Then finally, providing an ink reservoir on one surface of the connected body, and disposing the counter electrode in front of an end portion into which a deep cut of the connected body is made.

According to the above described method, it is possible to manufacture an ink-jet printing apparatus from a cut-out work, a cutting work, to simplify the manufacturing processes.

DETAILED DESCRIPTION OF THE PREFERRED EMBODIMENTS

Figure 1:
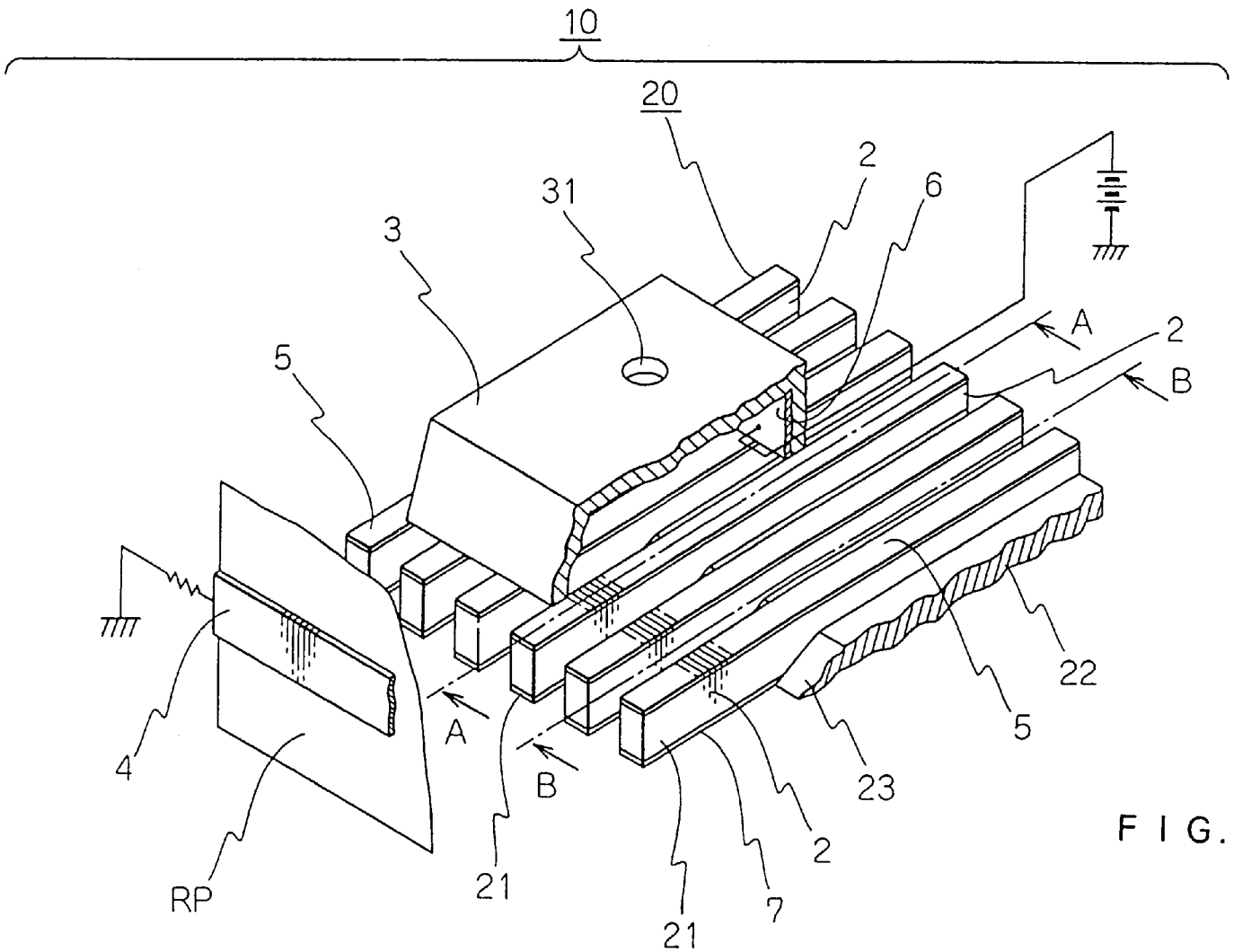
FIG. 1 is a diagram showing one embodiment of the present invention.

FIG. 1 shows the ink-jet printing apparatus 10. This ink-jet printing apparatus 10 includes sixty-four ink-ejecting bars 2 arranged to face the recording paper RP, the ink reservoir 3 supplies ink IK having toner to each of the ink-ejecting bars 2, the counter electrode 4 draws the toner in ink IK from a location faced to the pointed end 21 of each of the ink-ejecting bars 2, and a recording electrode 5 transports the toner in ink IK from the pointed end 21 of each of the ink-ejecting bars 2 to the recording medium.

Each of the ink-ejecting bars 2 is arranged in parallel with each other, and having a uniform distance from the recording paper RP. The cross-sectional shape of the ink-ejecting bar 2 is a rectangular, and an entire length is set to be 7–8 mm (FIG. 1 is representing with a reduced length). Also, a width of the ink-ejecting bar 2 is 40–45 micrometers. Preferably, this width is 42.3 micrometers. Further, a gap width which is formed between each of ink-ejecting bars 2 is 40–45 micrometers. Preferably, this width is 42.3 micrometers. Accordingly, a separation of each of the ink-ejecting bars 2 is arranged one by one with a separation of 80–90 micrometers. In particular, when a separation for each of the ink-ejecting bars 2 is 84.6 micrometers, this ink-jet printing apparatus 10 accurately implements a resolution of 300 dot per inch.

Each ink-ejecting bar 2 is made from a plate of an insulating ceramics which is a sheet of a piezoelectric material of a thickness 40–50 micrometers, having a longitudinal width 7–8 mm, and a transverse width 2.7 mm. On the upper face of this ceramics plate, by a dycing work, the sixty-three of the grooves having width of 40–45 micrometers are formed with constant spacings along the longitudinal direction. Thereby, the sixty-four convex parts are formed between each of the grooves.

Figure 2:
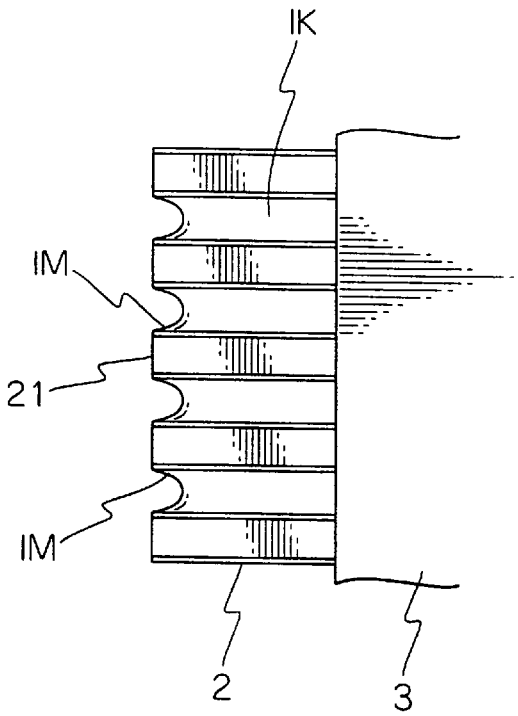
FIG. 2 is a diagram showing a meniscus formed on an pointed end of an ink-ejecting bar.

Further, by a dicing work, from one end to a mid-point part of the ceramics plate is deeply cut down until passing through a lower face. With this, the ceramics plate becomes a comb-like in shape, and each of the convex parts between each of grooves becomes the ink-ejecting bar 2. Also, no-cut part at the other end of each of these ink-ejecting bars becomes the connecting part 22 (fixed end) for connecting each of ink-ejecting bars 2 adjacent each other in constant spacings. In addition, the gaps and grooves of each of the ink-ejecting bars 2 become the flow paths of the ink IK supplied from the ink reservoir 3. Also, the meniscus IM of the ink is formed on the pointed end 21 of each of the ink-ejecting bars 2 (refer to FIG. 2). Hereinafter, a plurality of the ink-ejecting bars made from this ceramics plates are referred to as the connected body 20 of the ink-ejecting bar.

Figure 3:
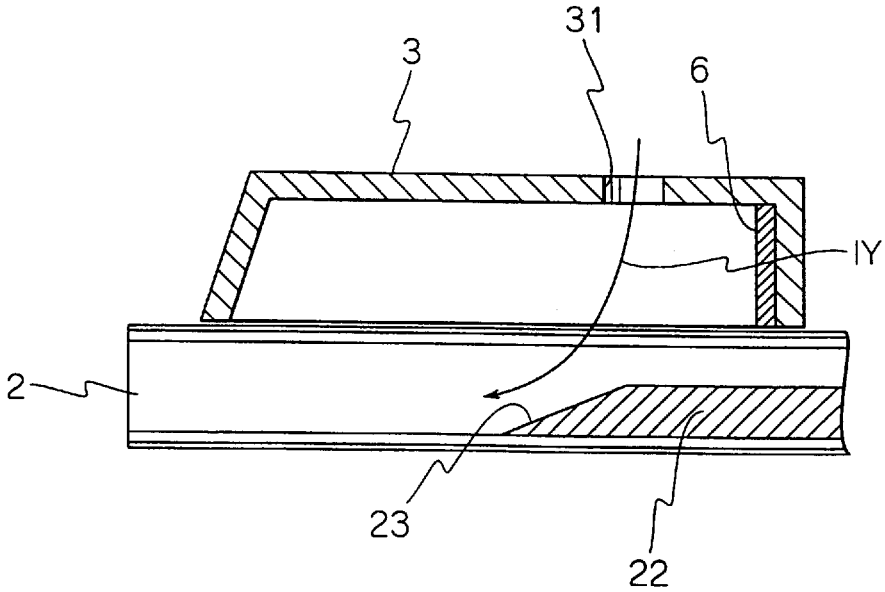
FIG. 3 is a diagram showing a cross-section of the ink-jet printing apparatus along the line B—B in FIG. 1.

On the upper part of the connected body 20 of the ink-ejecting bar, the ink reservoir 3 is placed. From this ink reservoir, ink IK is supplied to the gaps of each of the ink-ejecting bars 2. This ink IK is drawn to the pointed end 21 of the ink-ejecting bars 2 by counter electrodes 4 and the inductive electrodes 6 described below. For smoothing a shift of ink IK at that time, in each of the connecting parts 22, the inclined surface 23 faces the ink reservoir 3 and inclines toward the pointed end 21 side (for example, with an inclined angle 20 degree) (refer to FIG. 3). The arrow IY in FIG. 3 indicates a flow of ink IK. This inclined surface 23 is also formed by the above described dycing work.

Figure 4:
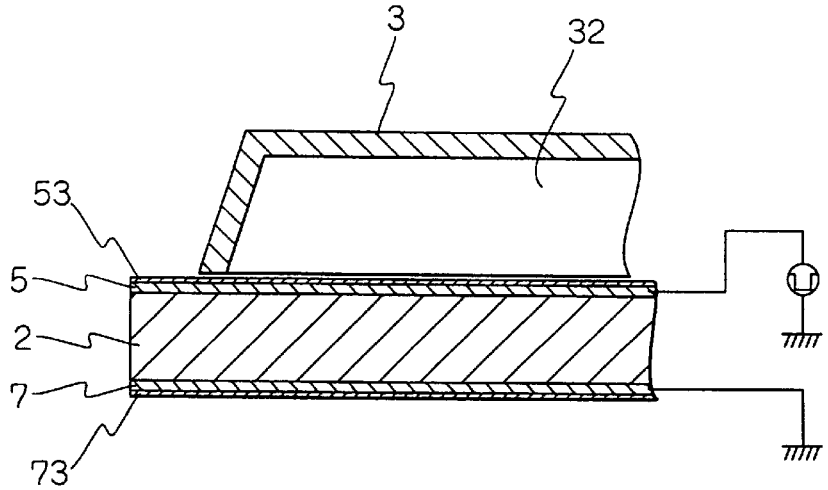
FIG. 4 is a diagram showing a cross-section of the ink-jet printing apparatus along the line A—A in FIG. 1.

The ink reservoir 3 is a box in which one face of its bottom is opened (refer to FIG. 4). This ink reservoir 3 is attached to a location withdrawn from the pointed end 21 of each of the ink-ejecting bars 2. The ink reservoir 3 is formed from an insulating material made of resin. Additionally, on its upper face, the ink inlet 31 is provided in the passed-through state from the upper face to the inside. Further, on the upper face of this ink reservoir 3, an ink outlet (not shown) is provided, in the same manner as the ink inlet 31.

The ink room 32 is formed between the upper surface of each of the ink-ejecting bars 2 and the ink reservoir 3. The inside of the ink room 32 is filled up with ink IK from the ink inlet 31. To this ink inlet 31, an ink tank and a tube (not shown) are connected. Further, a negative pressure with an extent of 1 cm $H_2O$ is applied to the inside of the ink reservoir 3 from the ink outlet. Because of this, ink IK inside of the ink reservoir 3 is circulated forcefully.

Ink IK for this ink-jet printing apparatus 10 is the one blended by so-called toner particles which are composed of a petroleum organic solvent (isoparaffin), fine particles of colored thermoplastic resin and substances for controlling the amount of electromagnetic charge. This toner particle is charged to a positive polarity by a zeta potential.

In front of the pointed end 21 of each of the ink-ejecting bars 2, the counter electrode 4 in a plate shape is disposed opposite the recording paper RP. The distance from the pointed end 21 of each of the ink-ejecting bars 2 to the counter electrode 4 is set to be about 300 micrometers. Also, the inductive electrode 6 in a plate shape is provided in the rear part of the inside of the ink reservoir 3, facing the counter electrode 4. This inductive electrode 6 is connected to a power supply, and a voltage with a positive polarity (1 kV) which is the same polarity as toner is being supplied thereto. On the other hand, since the counter electrode 4 is grounded, the electric potential becomes zero. Because of this, an electromagnetic field which is parallel to each of the ink-ejecting bars 2 occurs between the inductive electrode 6 and the counter electrode 4. By this electromagnetic field, toner in ink IK shifts to the pointed end 21 of the ink-ejecting bar 2. Because of this, in the location of near pointed end 21 of each of the ink-ejecting bars 2, the concentrations of toner particles are much higher than the one in the ink reservoir 3.

The recording electrode 5 for transporting toner concentrated on the pointed end 21 of the ink-ejecting bar 2 are provided on an upper face of each of ink-ejecting bars 2 (refer to FIG. 4). The recording electrode 5 is formed by pattern plating copper along the ink-ejecting bar 2 for each of the ink-ejecting bars 2. A thickness of each of the recording electrodes 5 is 20–30 micrometers. Each of recording electrodes 5 is coated with an insulating material 53 having a thickness of 10 micrometers. This insulating material 53 is formed by a chemical vapor deposition of parylene resin. Because of this, each of the recording electrodes 5 is insulated from other recording electrodes adjacent thereto.

Figure 5:
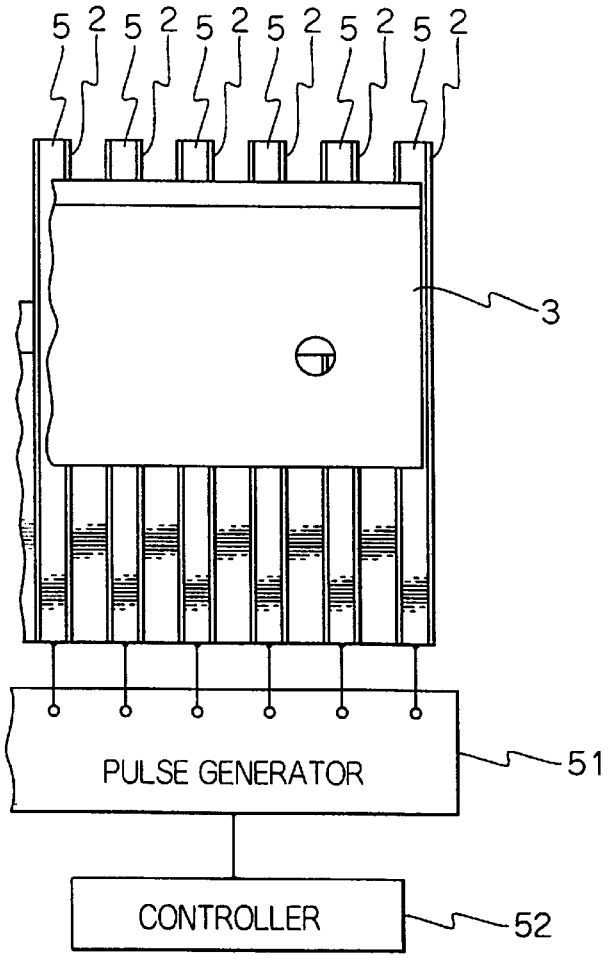
FIG. 5 is a diagram showing the wiring of a recording electrode.

Each of the recording electrodes 5 is connected to the pulse generator 51 which applies a pulse voltage separately (refer to FIG. 5). The pulse generator 51 applies a voltage of the same polarity as toner to a predetermined recording electrode 5. This pulse generator 51 applies a pulse voltage of 200–1000 V.

Further, the controller 52 is connected to the pulse generator 51. The controller 52 determines a selection of the recording electrodes 5 applying a pulse voltage, and determines an amount of the pulse voltage to apply. In this controller 52, these selections are made in accordance with the operation command signals which are inputted externally.

The driving electrodes for extending the ink-ejecting bars 2 are provided on the lower face of each of the ink-ejecting bars 2 (refer to FIG. 4). Each of the driving electrodes 7 is grounded. Furthermore, each of the driving electrodes 7 is formed by pattern plating copper along the ink-ejecting bar 2 for each of the ink-ejecting bars 2. A thickness of each of the driving electrodes 7 is 20–30 micrometers. Further, each of driving electrodes 7 is coated with an insulating material 73 of a thickness 10 micrometers. This insulating material 73 is formed by a chemical vapor deposition of parylane resin. Because of this, each of the driving electrodes 7 is insulated from other driving electrodes adjacent thereto.

In the ink-ejecting bar 2, when a pulse voltage is applied to the recording electrode 5, an electric current flows to the driving electrode 7 passing through the ink-ejecting bar 2. At this moment, since the ink-ejecting bar 2 is a piezoelectric material, a distorsion occurs in a direction perpendicular to the electric current. The pointed end 21 of that ink-ejecting bar 2 is extruded from other ink-ejecting bars, by that amount of distorsion (refer to FIG. 6(A)). Ordinarily, that extruded amount is about 10 micrometers.

Also, by applying the pulse voltage, an electromagnetic field occurs between the recording electrode 5 and the counter electrode 4. Utilizing this electromagnetic field, toner is transported to the recording paper RP side.

FIG. 6 is an illustration diagram showing a manufacturing method of the above described ink-jet printing apparatus 10. In accordance with this diagram, a manufacturing method of the ink-jet printing apparatus 10 will be described.

Figure 6A:
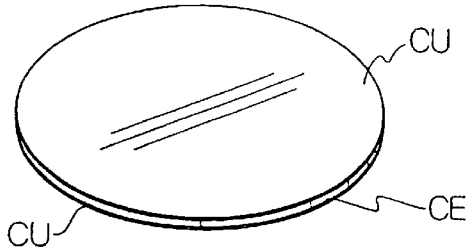
FIGS. 6(A) to (F) are diagrams illustrating the manufacturing process of an ink-jet printing apparatus.
Figure 6B:
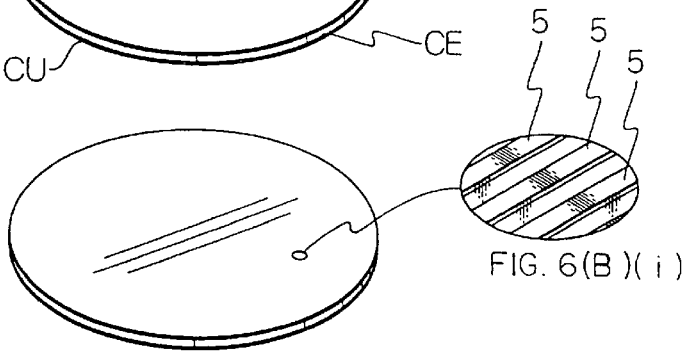

First, depositing copper films CU on both faces of the plate CE made from a piezoelectric material of ceramics (FIG. 6(A)). The deposition is implemented by pattern plating. Then, peeling off the copper films on each face of the plate in stripe shapes (FIG. 6(B)). This peel-off is implemented by dycing work. At this moment, digging into much deeply for one face thereof, and implementing the cut of grooves at the same time as the peel-off. The remaining copper films between the grooves on this face become the recording electrodes 5 as described above. Further, the remaining parts of copper films in the stripe shapes on the other face become the driving electrodes 7. Because of this, the location and the direction of peeling off are matched on both faces and then implemented.

Figure 6C:
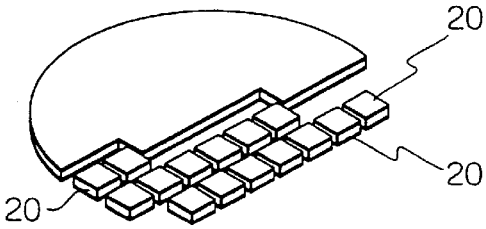

Next, cutting and dividing the plate of ceramics into the connected body units of the ink-ejecting bar (FIG. 6(C)). This cutting and dividing is implemented by corresponding it to the direction of the electrode.

Figure 6D:
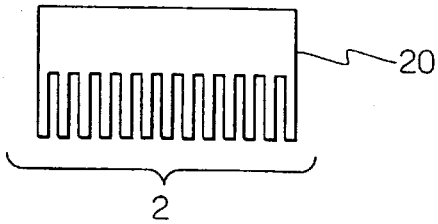

In the connected bodies of the ink-ejecting bar, which are cut and divided, a depth of cut is made from one end to a mid-way thereof along the space of each of the electrodes (FIG. 6(D)). This depth of cut is made by dycing work. Because of this, the connected bodies 20 of the ink-ejecting bar are processed to the comb shapes. At one end of this connected body of the ink-ejecting bar, a part corresponding to a space of each depth of cut becomes each of ink-ejecting bar 2.

Before and after this depth of cut work, a wiring with a wire-bonding is given on each of the electrodes 5 and 7.

Figure 6E:
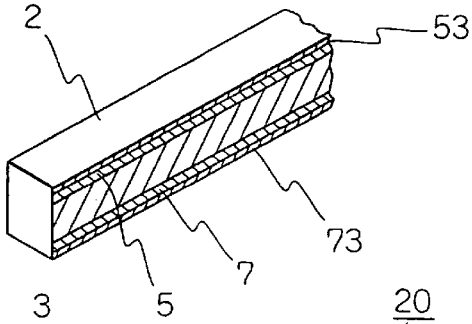
Figure 6F:
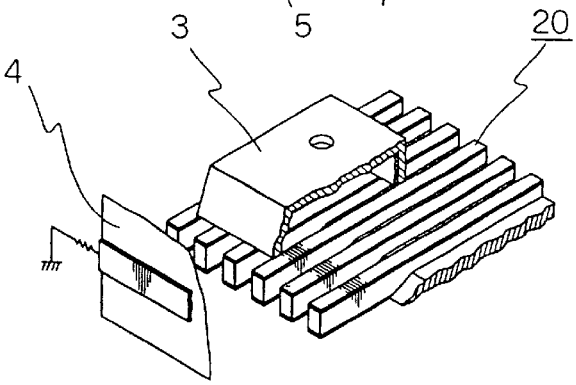

Further, the recording electrode 5 and driving electrode 7 of each of the ink-ejecting bars 2 are coated with the insulating materials 53, 73 which are parylane resins. At this moment, preferably an entire surface of the connected body 20 is coated with an insulating material. FIG. 6(E) shows a state of which the ink-ejecting bar 2 has been coated with an insulating material. This FIG. 6 (E) shows a cross-section along a longitudinal direction of the ink-ejecting bar 2.

Finally, the ink reservoir 3 is adhered to one face of the connect ed body 20 of the ink-ejecting bar. Also, the counter electrode 4 is disposed with facing to the pointed end 21 of each of the ink-ejecting bars 2.

In the above mentioned manufacturing method, the dycing work and the cut work are the main. On the one hand, this manufacturing method has very little dependency of a sputtering work and a lithography. Because of this, according to this manufacturing method, it is possible to easily plan a simplification of the manufacturing process.

Figure 7:
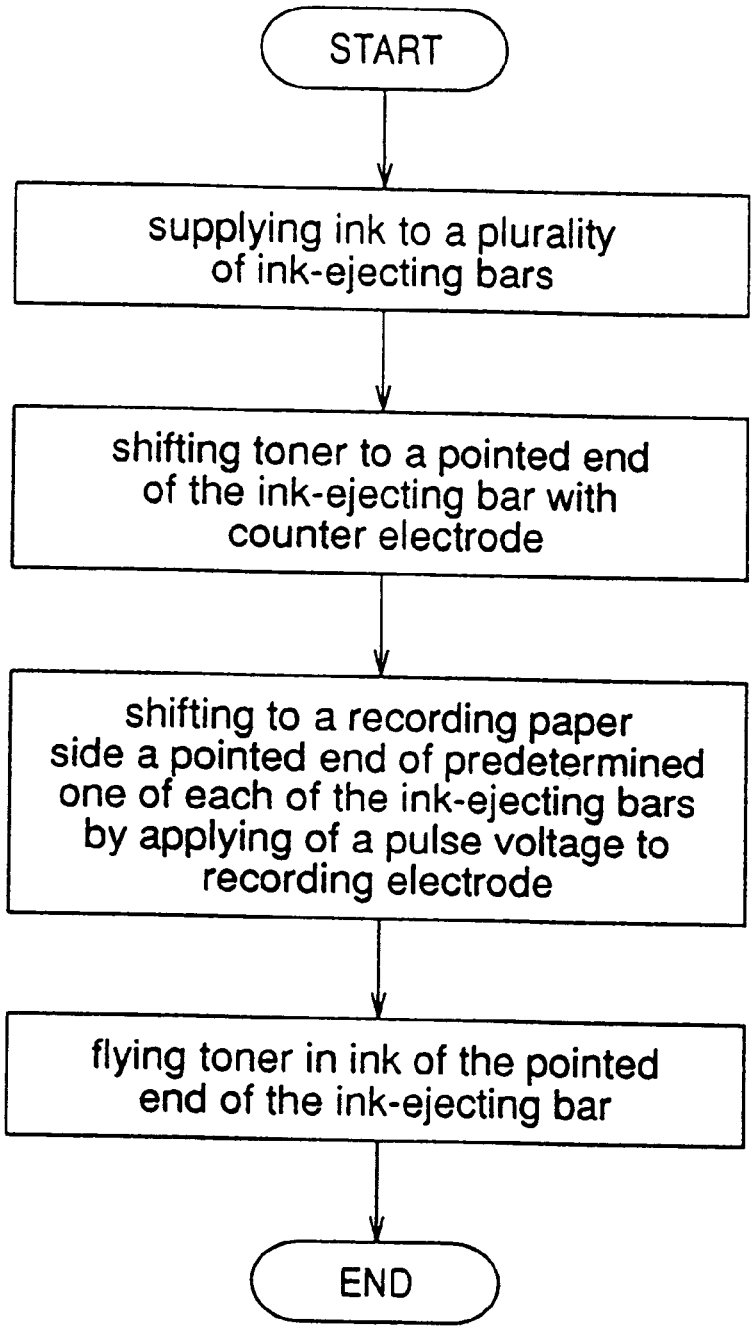
FIG. 7 is a flowchart showing an operation of an ink-jet printing apparatus.

FIG. 7 is a flowchart showing the printing method. The above described ink-jet printing apparatus 10 implements a printing according to this printing method. In the following, the operation of the ink-jet printing apparatus 10 is described.

First, ink IK is supplied from the ink reservoir unit 3 to the space of each of the ink-ejecting bars 2 (step S1). At this moment, a flow of ink IK is directed to the pointed end side 21 of the ink-ejecting bar 2, from the inclined surface 23 disposed in each of the connected units 22 of the ink-ejecting bar 2.

Also, at this moment, a voltage of 1 kV is applied to the inductive electrode 6 in advance, and an electromagnetic field forwarding from this inductive electrode 6 to the counter electrode is generated. Toner in ink IK shifts to the pointed end 21 of the ink-ejecting bar 2, according to this electromagnetic field (step S2). Toner concentration in ink IK becomes higher at the pointed end 21 of the ink-ejecting bar 2.

Next, in the controller 52, a selection of the recording electrode 5 is made, on a basis of an operation command signal from an exterior. The controller 52 dispatches a pulse voltage to the recording electrode 5 to be aimed. Because of this, in a predetermined ink-ejecting bar 2, a distorsion occurs between the recording electrode 5 and the driving electrode 7 by an electrical potential difference. Because this distorsion is occurred in a longitudinal direction of the ink-ejecting bar, the pointed end 21 thereof shifts toward the recording paper RP (the counter electrode 4 side) side (step S3).

Figure 8A:
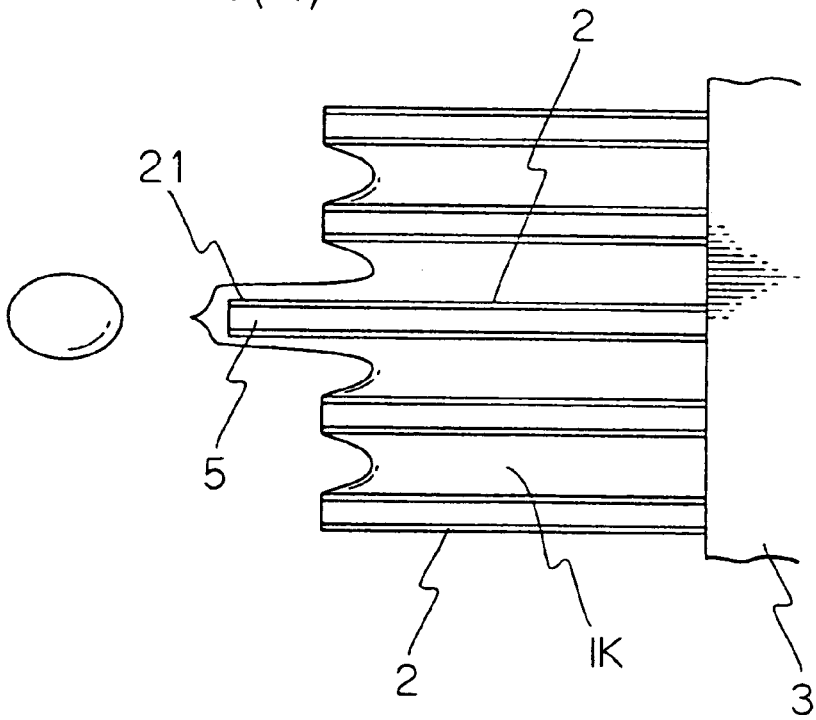
FIG. 8 is a diagram showing the transport state of toner, FIG. 8 (A) showing a case in which a large pulse voltage is applied to a recording electrode, and FIG. 8(B) showing a case in which a small pulse voltage is applied to a recording electrode.

Also, on the one hand, an electromagnetic field is generated between the recording electrode 5 and the counter electrode 4. At this moment, since a distance between the recording electrode 5 and the counter electrode 4 is reduced due to the shift of pointed end 20 towards control electrode 4 ink-ejecting bar 2, a concentration of an electromagnetic field tends to take place at the pointed end 21 of this ink-ejecting bar 2. The charged toner in the meniscus IM of ink that is formed at the pointed end 21 of this ink-ejecting bar 2 receives an attractive force because of that electromagnetic field. Because of this, ink IK of the meniscus IM shifts to the pointed end 21. Then, toner is drawn from the pointed end 21 as a group, and flies toward the counter electrode 4 (step S4, refer to FIG. 8(A)). Toner collides to the recording paper RP on the way, and becomes the recording dots.

The recording paper RP is delivered to a heater which is not shown in the figures. Then a fixation of the recording dots is implemented by heating and then the printing is completed.

Also, in the above described controller 52, the pulse voltage to be applied is varied with the range of 200–1000 V, according to the operation command signal which designates the size of the recording dots. According to this, because the electric potential difference between the recording electrode 5 and the driving electrode 7 changes, the distorsion extrusion amount of the ink-ejecting bar 2 will vary.

For example, the controller 52 sets the pulse voltage higher when enlarging the recording dots (1000 V). Because of this, the shifting amount of the ink-ejecting bar 2 becomes larger, thereby the distance from the pointed end 21 thereof to the counter electrode 4 becomes shorter. For this reason, a much stronger electromagnetic field is occurred between the recording electrode 5 and the counter electrode 4, and an amount of transported toner to fly increases. Therefore, much larger recording dots are formed on the recording paper RP (refer to FIG. 8(A)).

Figure 8B:
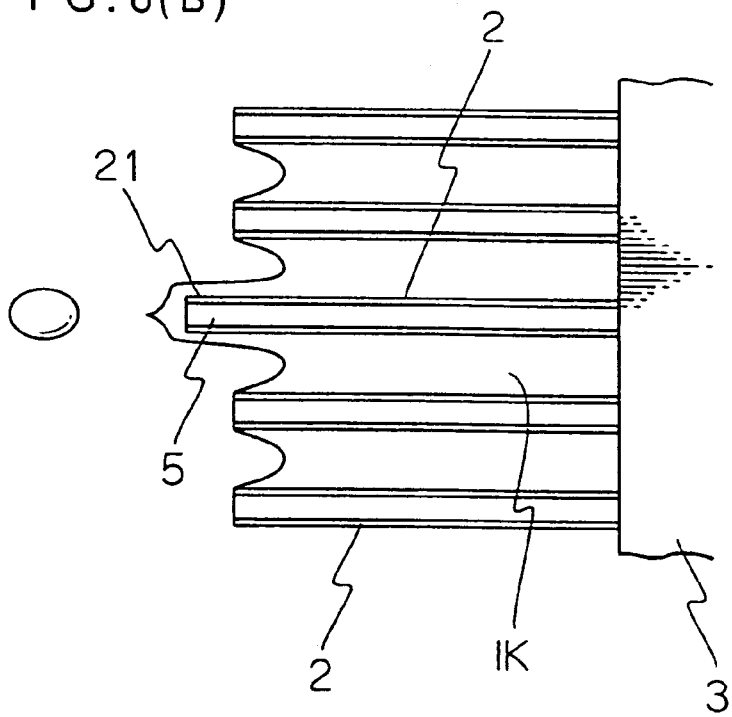

Further, the controller 52 sets the pulse voltage lower when making the recording dots smaller (200 V). Because of this, the shifting amount of the ink-ejecting bar 2 becomes smaller, thereby the distance from the pointed end 21 thereof to the counter electrode 4 becomes longer. Because of this, a weaker electromagnetic field than the above described one is occurred between the recording electrode 5 and the counter electrode 4, thereby the amount of toner to fly decreases. Therefore, smaller recording dots are formed on the recording paper RP (refer to FIG. 8(B)).

In the ink-jet printing apparatus 10, when flying toner in ink, the pointed end 21 of the ink-ejecting bar 2 is pushed out to the recording paper RP side. According to this, the electromagnetic field concentrates to a small area of the pointed end 21 of this ink-ejecting bar 2, and toner will be transported. Because of this, toner can always be transported stably from the fixed location. That is, the location displacement of the recording dots could be dissolved.

Further, in the ink-jet printing apparatus 10, the shift of the pointed end 21 of the ink-ejecting bar 2 and the fly of toner are implemented simultaneously by applying the pulse voltage to the recording electrode 5. Because of this, the numbers of electrodes required for each operation could be reduced, and it is possible to plan a simplification of the apparatus.

Moreover, in the ink-jet printing apparatus 10, because of including the inductive electrode 6, toner can always be concentrated to the pointed end 21 of the ink-ejecting bar 2. According to this, a decrease of a printing density can be prevented. In addition, a backflow of toner can be prevented when applying the pulse voltage to the recording electrode 5.

Finally, the ink-jet printing apparatus 10 includes the controller 52 for adjusting the pulse voltages to be applied to each of the recording electrodes 5. According to this, the shifting amount of the pointed end 21 of the ink-ejecting bar 2 can be adjusted according to the high and low of the pulse voltage. Because of this, the amount of toner to be transported can be adjusted, and thus it is possible to adjust the size of recording dots to be formed on the recording paper RP.

Figure 9:
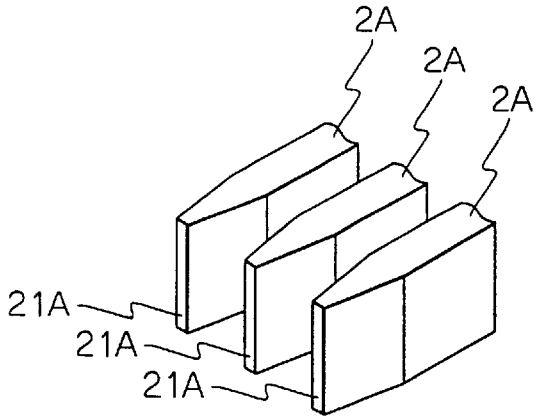
FIG. 9 is a diagram showing an example in which a pointed end of an ink-ejecting bar is more detailed than other parts thereof.

FIG. 9 shows another example of the pointed end of the ink-ejecting bar. For the pointed end 21A of this ink-ejecting bar 2A, a width thereof is formed thinner, comparing to other part of the ink-ejecting bar 2A. For example, if a width of other part of the ink-ejecting bar 2A is set to 42.3 micrometers, then the width of the pointed end 21A is set to 21 micrometers which is a half thereof. Because of this, for the pointed end 21A of the ink-ejecting bar 2A, a point end area thereof is made smaller comparing to the one of the ink-ejecting bar 2. According to this, because, at a time of printing, ink IK concentrates on this pointed end 21A of a smaller area, a location displacement of toner at a time of transporting can be suppressed, thereby a stable printing is implemented.

Figure 10:
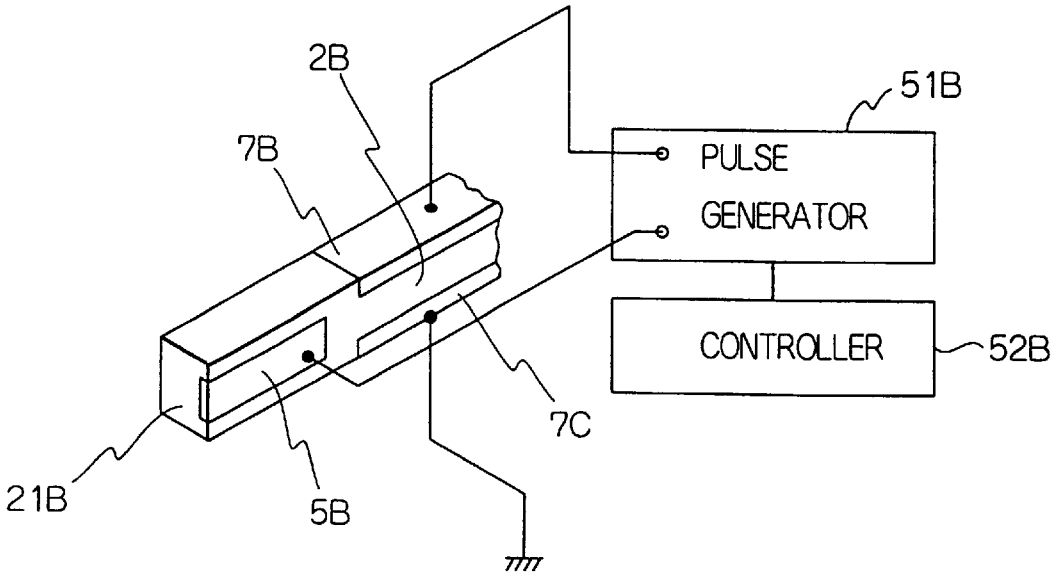
FIG. 10 is a diagram showing a case in which two driving electrodes are installed.

FIG. 10 shows an example of providing two driving electrodes, for one of the ink-ejecting bars. In this ink-ejecting bar 2B, the recording electrode 5B is provided to the pointed end 21B of the ink-ejecting bar 2B. This recording bar 5B is connected to the pulse generator 51B which applies a pulse voltage.

Then, the driving electrodes 7B, 7C are equipped at the locations away from the recording electrode 5B of the ink-ejecting bar 2B. These driving electrodes 7B, 7C are attached to the upper and lower faces of the ink-ejecting bar 2B along the ink-ejecting bar 2B, respectively. According to this, each of the driving electrodes 7B, 7C is in symmetry with each other by interposing the ink-ejecting bar 2B. Then, one of the driving electrodes 7B is connected to the pulse generator 51B, and the other one of the driving electrode 7C is grounded. Further, an entire surface of the ink-ejecting bar 2B is coated with an insulating material, but showing in the figure will be omitted.

The pulse generator 51B is also connected to other recording electrodes 5B and driving electrodes 7B of which showing in the figure is omitted, and a voltage of the same polarity as the one of toner is applied to the predetermined recording electrode 5B and the driving electrode 7B. Also, this pulse generator 51B can adjust a pulse voltage to be applied between 200 to 1000 V. Further, the controller 52B established in the pulse generator 51B will determine a selection of the recording electrode 5B and the driving electrode 7B which apply the pulse voltage, and the size of the pulse voltage to be applied to the driving electrode 7B (to the recording electrode 5B, the pulse voltage is applied with a constant electric potential).

In a case of this configuration, the shift of the pointed end 21B of the ink-ejecting bar 2B, and the transport of toner are implemented by the pulse voltages to be applied from the different electrode 5B and electrode 7B, respectively. Because of this, the timing of the shift of the pointed end 21B of the ink-ejecting bar 2B and the fly of toner can be changed, and it is possible to adjust to the most suitable timing.

The invention may be embodied in other specific forms without departing from the spirit or essential characteristic thereof. The present embodiments is therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application Nos. 8-337320 (Filed on Dec. 17, 1996) including specification, claims, drawings and summary are incorporated herein by reference in its entirety.

What is claimed is:

1. An ink-jet printing apparatus, comprising:

(a) a plurality of ink-ejecting bars each having an unsecured end, said unsecured end operative to be shifted toward a recording medium in response to a signal;

(b) an ink reservoir for supplying ink to each of said ink-ejecting bars; and (c) a circuit for producing said signal and selectively applying the signal to said ink-ejecting bars whereby the ink-ejecting bars are shifted because of the signal.

2. An ink-jet printing apparatus according to claim 1, wherein said unsecured end of each of said ink-ejecting bars is made smaller than other parts thereof.

3. An ink-jet printing apparatus according to claim 1, wherein each of said ink-ejecting bars is made of a piezoelectric material.

4. An ink-jet printing apparatus according to claim 1, further comprising:

(a) a recording electrode located on one surface of said bar; and (b) a driving electrode located on another surface of the bar.

5. An ink-jet printing apparatus according to claim 4, wherein surfaces of said recording electrodes and said driving electrodes not in contact with said ink-ejecting bar are coated with an insulating material.

6. An ink-jet printing apparatus according to claim 4, further comprising a controller for supplying a signal to said recording electrodes, said signal corresponding to a shift in said unsecured end of the ink-ejecting bars.

7. An ink-jet printing apparatus according to claim 6, wherein said controller determines a voltage applied to said recording electrodes in accordance with a size of a dot to be printed.

8. An ink-jet printing apparatus according to claim 1, wherein each of said ink-ejecting bars is connected at a fixed end and forms a comb-like shape.

9. An ink-jet printing apparatus according to claim 8, wherein said comb-like shape comprises grooves on the surface of the plate.

10. An ink-jet printing apparatus according to claim 8, wherein surface ink reservoir is disposed on an upper side of said connected ink-ejecting bars and having a slope on said connecting part of said bars, said slope being faced to said ink reservoir and inclined to said pointed end side of an ink-ejecting bar for ejecting said ink.

11. An ink-jet printing apparatus according to claim 1, further comprising:

an inductive electrode for inducing said ink to said unsecured end of said ink-ejecting bar, and having a voltage with the same polarity as said ink being supplied thereto; wherein said inductive electrode is disposed inside the ink reservoir.

12. An ink-jet printing apparatus according to claim 1, wherein each of said ink-ejecting bars has a width of 40–45 micrometers.

13. An ink-jet printing apparatus according to claim 1, wherein each of said ink-ejecting bars is connected with a separation of 80–90 micrometers.

14. An ink-jet printing apparatus according to claim 1, further comprising at least one electrode coupled to said ink-ejecting bar to supply a signal thereto.

15. An ink-jet printing apparatus according to claim 14, wherein said electrode is a recording electrode for transporting said ink from said ink-ejecting bars to said recording medium.

16. An ink-jet printing apparatus according to claim 15, wherein said surface of each of said driving electrodes is coated with an insulating material.

17. An ink-jet printing apparatus according to claim 15, wherein the driving electrode is coupled along a longitudinal surface of said ink-ejecting bar.

18. An ink-jet printing apparatus according to claim 14 wherein said electrode is a driving electrode for shifting said ink-ejecting bar.

19. An ink-jet printing apparatus according to claim 1, further comprising a counter electrode for causing ink at said unsecured end of said ink-ejecting bars to be ejected toward said counter electrode.

20. An ink-jet printing apparatus according to claim 1, wherein said ink-ejecting bars are rectangular in shape.

21. An ink-jet printing apparatus according to claim 1, wherein the inside of said ink reservoir exhibits a negative pressure.

22. A printing method, comprising the steps of:

(a) supplying ink to a plurality of ink-ejecting bars facing a recording medium;

(b) transporting ink to an unsecured end of said ink-ejecting bar;

(c) shifting one of said unsecured ends toward said recording medium in response to a signal; and (d) transporting ink from said unsecured end of said ink-ejecting bar in the direction of the recording medium.

23. The printing method according to claim 22, further comprising the step of applying a signal to the recording electrodes disposed at said unsecured end of each of said ink-ejecting bars in order to transport ink.

24. The printing method according to claim 22, further comprising the step of applying a signal separately to each of said ink-ejecting bars.

25. The printing method according to claim 22, further comprising the step of controlling size of a dot to be printed on a recording medium by varying an amount of a forward shifting of the unsecured end of said ink-ejecting bar.

26. The printing method according to claim 25, further comprising the step of printing a larger dot by increasing a forward shifting of the unsecured end of said ink-ejecting bar.

27. The printing method according to claim 25, further comprising the step of printing a smaller dot by decreasing the forward shifting of the unsecured end of said ink-ejecting bar.

28. A method of manufacturing an ink-jet printing apparatus, comprising the steps of:

(a) depositing conductive material on both sides of a piezoelectric material;

(b) peeling off each of the conductive materials deposited on both sides of said piezoelectric material in stripes to form electrodes;

(c) cutting and dividing a connected body of an ink-ejecting bar from said piezoelectric material;

(d) cutting deeply from one end to a mid-way of said connected body to form a gap between electrodes of the connected body of the ink-ejecting bar;

(e) coating both sides of said connected body with insulating material; and (f) providing an ink reservoir on one of the surfaces of the connected body, and (g) disposing a counter electrode in front of the ink-ejecting bars.

29. A method of manufacturing an ink-jet printing apparatus according to claim 28, further comprising peeling off said conductive materials and cutting of said connected body by a dicing processes.

30. A method of manufacturing an ink-jet printing apparatus according to claim 29, further comprising forming a plurality of grooves on the conductive coated side of the piezoelectric material.

* * * * *

UNITED STATES PATENT AND TRADEMARK OFFICE

CERTIFICATE OF CORRECTION

PATENT NO. : 6,155,672
DATED : December 5, 2000
INVENTOR(S) : Junichi Suetsugu, Shima, Kazuo, Mizoguchi, Tadashi, Minemoto, Hitoshi, Takemoto, Hitoshi, Hagiwara, Yoshihiro It is certified that error appears in the above-identified patent and that said Letters Patent is hereby corrected as shown below:

Column 1,
Line 11, delete "is" insert -- it --;
Line 36, delete "enabling" insert -- enable --

Column 2,
Lines 6-7, delete "flying toner in ink of" insert -- transporting the toner and ink form --;
Lines 7-8, delete "a direction of a" insert -- the --;
Line 8, delete "paper" insert -- medium --;
Line 11, delete "fly toner" insert -- transport ink and toner --

Column 5,
Line 62, delete "connect ed" insert -- connected --

Column 6,
Line 62, after "extrusion: insert -- (or extension) --

Column 7,
Line 4, delete "to fly"

Column 9,
Line 20, delete "forms";
Line 25, delete "side" insert -- surface --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*